US008316663B2

(12) United States Patent
Okaichi et al.

(10) Patent No.: US 8,316,663 B2
(45) Date of Patent: Nov. 27, 2012

(54) EXPANDER-COMPRESSOR UNIT AND REFRIGERATION CYCLE APPARATUS HAVING THE SAME

(75) Inventors: Atsuo Okaichi, Osaka (JP); Yasufumi Takahashi, Osaka (JP); Hiroshi Hasegawa, Osaka (JP); Masaru Matsui, Kyoto (JP); Fuminori Sakima, Osaka (JP)

(73) Assignee: Panasonic Corporation, Osaka (JP)

( * ) Notice: Subject to any disclaimer, the term of this patent is extended or adjusted under 35 U.S.C. 154(b) by 873 days.

(21) Appl. No.: 12/438,060

(22) PCT Filed: Apr. 2, 2008

(86) PCT No.: PCT/JP2008/000852

§ 371 (c)(1),
(2), (4) Date: Feb. 19, 2009

(87) PCT Pub. No.: WO2008/142822

PCT Pub. Date: Nov. 27, 2008

(65) Prior Publication Data

US 2010/0162750 A1 Jul. 1, 2010

(30) Foreign Application Priority Data

May 16, 2007 (JP) ..... 2007-130098

(51) Int. Cl.
*F25B 43/02* (2006.01)
*F25B 1/00* (2006.01)

(52) U.S. Cl. ..... 62/468; 62/469; 62/498

(58) Field of Classification Search ..... 62/84, 193, 62/468

See application file for complete search history.

(56) References Cited

U.S. PATENT DOCUMENTS

| | | | | |
|---|---|---|---|---|
| 2,062,035 | A * | 11/1936 | McCormack | 417/281 |
| 4,875,838 | A * | 10/1989 | Richardson, Jr. | 418/55.4 |
| 6,428,236 | B2 * | 8/2002 | Aota et al. | 403/359.5 |
| 2005/0115771 | A1 * | 6/2005 | Shin | 184/6.16 |
| 2006/0084546 | A1 * | 4/2006 | Kohno et al. | 475/160 |
| 2006/0130495 | A1 | 6/2006 | Dieckmann et al. | |

FOREIGN PATENT DOCUMENTS

| | | | |
|---|---|---|---|
| JP | 62-077562 | A | 4/1987 |
| JP | 2001-165040 | A | 6/2001 |
| JP | 2003-139059 | A | 5/2003 |
| JP | 2005-264829 | * | 9/2005 |
| JP | 2005-264829 | A | 9/2005 |

(Continued)

*Primary Examiner* — Frantz Jules
*Assistant Examiner* — Henry Crenshaw
(74) *Attorney, Agent, or Firm* — Hamre, Schumann, Mueller & Larson, P.C.

(57) ABSTRACT

An expander-compressor unit (30) includes: a closed casing (1) holding an oil at a bottom portion thereof; a motor (2) provided in the closed casing (1); a compression mechanism (3) for compressing a refrigerant and discharging it into the closed casing (1), the compression mechanism (3) being disposed below the motor (2) in the closed casing (1); an expansion mechanism (4) disposed below the compression mechanism (3) in the closed casing (1); and a coupling mechanism (50) for coupling a compression mechanism side shaft (5) to an expansion mechanism side shaft (6). An oil supply passage (53) for supplying the oil to the compression mechanism (3) is formed in the compression mechanism side shaft (5). An oil suction port (53A) is provided in a portion of the compression mechanism side shaft (5), the portion being above the expansion mechanism (4).

10 Claims, 12 Drawing Sheets

FOREIGN PATENT DOCUMENTS

| | | | |
|---|---|---|---|
| JP | 2005-299632 | * | 10/2005 |
| JP | 2005299632 | * | 10/2005 |
| JP | 2006-105564 A | | 4/2006 |
| JP | 2006-132329 | | 5/2006 |
| JP | 2007-127018 A | | 5/2007 |
| JP | 2007-315227 A | | 12/2007 |

* cited by examiner

EXPANDER-COMPRESSOR UNIT AND REFRIGERATION CYCLE APPARATUS HAVING THE SAME

TECHNICAL FIELD

The present invention relates to an expander-compressor unit applied to a refrigeration cycle apparatuses, such as a refrigerator, an air conditioner, and a water heater, and also relates to a refrigeration cycle apparatus having the expander-compressor unit.

BACKGROUND ART

As a fluid machine forming a part of a refrigeration cycle apparatus, an expander-compressor unit 400 is known that is constituted by integrating a compression mechanism 402 for compressing a refrigerant with an expansion mechanism 404 for allowing a refrigerant to expand and converting into mechanical energy the expansion energy generated during the refrigerant is expanded and decompressed, as shown in FIG. 6 (see JP 62(1987)-77562 A). In the expander-compressor unit 400, the mechanical energy resulted from the conversion by the expansion mechanism 404 is utilized as a part of energy for rotating a shaft 405 of the compression mechanism 402. This reduces input to the compression mechanism 402 from outside, and improves the efficiency of the refrigeration cycle apparatus.

Since the compression mechanism 402 adiabatically compresses the refrigerant, a temperature of the refrigerant rises in the compression mechanism 402. Accordingly, temperatures of components of the compression mechanism 402 also rise in accordance with the rising temperature of the refrigerant. On the other hand, the expansion mechanism 404 draws the refrigerant cooled by a radiator, which is not shown, and allows the drawn refrigerant to expand adiabatically. Accordingly, the temperature of the refrigerant lowers in the expansion mechanism 404. As a result, temperatures of components of the expansion mechanism 404 lower in accordance with the lowering temperature of the refrigerant. Thus, mere integration of the compression mechanism 402 and the expansion mechanism 404 as described in JP 62(1987)-77562 A allows the heat of the compression mechanism 402 to transfer to the expansion mechanism 404, which heats the expansion mechanism 404 and cools the compression mechanism 402. In this case, in an actual cycle, enthalpy of the refrigerant discharged from the compression mechanism 402 decreases (see Point B→Point B1) and heating capacity of the radiator deteriorates to be lower than in a theoretical cycle, as shown in the Mollier diagram of FIG. 7. Moreover, enthalpy of the refrigerant discharged from the expansion mechanism 404 increases (see Point D→Point D1), and refrigerating capacity of an evaporator deteriorates. The deteriorations in the capacities of the radiator and the evaporator are not preferable because they mean a decrease in the efficiency of the refrigeration cycle apparatus.

Particularly, when the refrigeration cycle apparatus is used as a water heater, it needs to heat water by its radiator to a temperature predetermined for hot reserve water. Accordingly, the refrigerant used for heating, that is, the discharge refrigerant from the compression mechanism 402, must have a temperature higher than the predetermined temperature for reserved hot water. However, when a thermal short occurs between the compression mechanism 402 and the expansion mechanism 404, the temperature of the discharge refrigerant from the compression mechanism 402 lowers, and accordingly, the temperature of the reserved hot water lowers. There is a method of increasing a pressure of the discharge refrigerant from the compression mechanism 402 in order to compensate the temperature of the discharge refrigerant from the compression mechanism 402 lowered by the thermal short. In the Mollier diagram of FIG. 8, Point A→Point B2→Point C2→Point D2 shows a theoretical cycle of discharge temperature control, and Point A→Point B3→Point C2→Point D3 shows an actual cycle of discharge temperature control. As seen, when the refrigerant is compressed somewhat excessively, the temperature of the discharge refrigerant can be raised, and thereby the temperature of the discharge refrigerant substantially can be maintained at the target temperature. However, this method makes the compression mechanism 402 perform excessive work, increasing the power consumption at a motor. Therefore, the effect in recovering mechanical power by the expansion mechanism 404 is reduced.

In order to solve such a problem, a configuration is known in which a heat insulating material 504 is provided between a compression mechanism 501 and a expansion mechanism 502 as shown in FIG. 9 (see JP 2001-165040 A). Reference numeral 503 indicates a shaft coupled to the compression mechanism 501 and the expansion mechanism 502. Since the heat insulating material 504 is sandwiched between the compression mechanism 501 and the expansion mechanism 502 in the configuration shown in FIG. 9, heat transfer between the compression mechanism 501 and the expansion mechanism 502 can be reduced. However, such a configuration increases the cost for the heat insulating material 504.

On the other hand, an expander-compressor unit also is known that reduces the heat transfer between the compression mechanism and the expansion mechanism without the heat insulating material (see JP 2005-264829 A). JP 2005-264829 A discloses a configuration in which a compression mechanism 602 and an expansion mechanism 604 are disposed spaced apart, and an interior of a closed casing 601 is filled with a low pressure refrigerant guided from an evaporator to the compression mechanism 602, as shown in FIG. 10.

A configuration also is known in which an interior of a closed casing 701 is partitioned into a low pressure side space 752 and a high pressure side space 751, an expansion mechanism 702 is provided in the low pressure side space 752 while a compression mechanism 704 is provided in the high pressure side space 751, as shown in FIG. 11 (see JP 2006-105564 A). In the expander-compressor unit of FIG. 11, the suction refrigerant that will be drawn into the compression mechanism 704 is guided to the low pressure side space 752, and the refrigerant that has been discharged from the compression mechanism 704 is guided to the high pressure side space 751.

In the configuration shown in FIG. 10, the compression mechanism 602 and the expansion mechanism 604 are separated from each other, and thereby heat transfer between the compression mechanism 602 and the expansion mechanism 604 can be reduced. A surrounding space of the expansion mechanism 604 is filled with a relatively low temperature refrigerant that will be drawn into the compression mechanism 602. This makes it possible to suppress an increase in enthalpy of the refrigerant discharged from the expansion mechanism 604. Although the heat transfer occurs also between the compression mechanism 602 and the suction refrigerant, the refrigerant that has received heat from the compression mechanism 602 is compressed by the compression mechanism 602, and heats the compression mechanism 602. Therefore, the discharge temperature of the compression mechanism 602 does not lower. As a result, a decrease in enthalpy of the refrigerant discharged from the compression mechanism 602 is suppressed.

However, in the configuration in which the interior of the closed casing 601 is filled with the low pressure refrigerant as described above, the discharge refrigerant from the compression mechanism 602 is discharged directly out of the closed casing 601 via a discharge pipe 609. Thus, an amount of the oil discharged out of the closed casing 601 is larger in this configuration than in the configuration in which the interior of the closed casing 601 is filled with the discharge refrigerant from the compression mechanism 602. The discharged oil adheres to a refrigerant pipe and increases pressure loss of the refrigerant, as well as deteriorates the capacities of the radiator and the evaporator, exerting an adverse effect on the performance of the refrigeration cycle apparatus.

On the other hand, in the configuration shown in FIG. 11, the discharge refrigerant from the compression mechanism 704 is once released into the high pressure side space 751 of the closed casing 701, and then is discharged from the closed casing 701 toward the radiator via a discharge pipe 709. Since the discharge refrigerant is once released into the high pressure side space 751 in this way, the oil is separated easily from the discharge refrigerant from the compression mechanism 704 in the closed casing 701. Thus, the discharge refrigerant from the compression mechanism 704 does not circulate in the refrigeration cycle apparatus together with a lot of oil However, since the interior of the closed casing 701 is partitioned into the low pressure side space 752 and the high pressure side space 751, a shaft 705 coupling the expansion mechanism 702 to the compression mechanism 704 needs to penetrate through a partition 750. Such a configuration absolutely requires a mechanical seal for preventing the refrigerant from leaking through a clearance between the shaft 705 and the partition 750. There arises a concern that the sliding loss may be increased between the shaft 705 and the mechanical seal.

As the layout of the compression mechanism, the expansion mechanism, and the motor in such an expander-compressor unit, JP 2003-139059 A proposes four kinds of layouts shown in FIG. 12A to FIG. 12D. In FIG. 12A to FIG. 12D, C indicates the compression mechanism, M indicates the motor, E indicates the expansion mechanism, and P indicates an oil pump. However, JP 2003-139059 A does not disclose detailed configuration of each layout. In each configuration shown in FIG. 12A to FIG. 12D, the oil supplied from the oil pump is supplied to the compression mechanism and the expansion mechanism via an oil supply passage provided in the shaft. That is, the oil passes through one of the compression mechanism and the expansion mechanism, and thereafter passes through the other. This causes the heat transfer to occur between the compression mechanism and the expansion mechanism via the oil.

DISCLOSURE OF INVENTION

In view of the foregoing, the present invention is intended to provide an expander-compressor unit that can suppress a discharge amount of oil, and can reduce the heat transfer between the compression mechanism and the expansion mechanism without increasing mechanical loss.

The expander-compressor unit of the present invention includes: a closed casing having, in a bottom portion thereof, an oil reservoir for holding an oil; a motor provided in the closed casing; a compression mechanism for compressing a working fluid drawn from outside of the closed casing and discharging it into the closed casing, the compression mechanism being disposed below the motor in the closed casing; an expansion mechanism for allowing the working fluid drawn from outside of the closed casing to expand and discharging it out of the closed casing, the expansion mechanism being disposed below the compression mechanism in the closed casing; a shaft extending vertically and being coupled to the motor, the compression mechanism, and the expansion mechanism; and an oil supply passage for supplying the oil held in the oil reservoir to the compression mechanism. An oil suction portion for drawing the oil toward the oil supply passage is located above the expansion mechanism.

In the expander-compressor unit of the present invention, the motor, the compression mechanism, and the expansion mechanism are disposed from top to bottom in the closed casing in descending order of temperature. As a result, a stratified temperature-distribution is formed in the refrigerant and the oil based on the temperature gradient in the closed casing. This makes it possible to reduce heat transfer caused by convection of the refrigerant and the oil in the closed casing.

The oil suction portion of the oil supply passage for supplying the oil to the compression mechanism is disposed at a position above the expansion mechanism. Thus, the relatively high temperature oil present higher than the expansion mechanism is supplied to the compression mechanism, and the relatively low temperature oil present lower than the oil suction portion is supplied to the expansion mechanism. This enables circulation of the high temperature oil, which lubricates the compression mechanism, above the expansion mechanism, and can prevent the expansion mechanism from receiving heat from the high temperature oil. As a result, the heat transfer between the compression mechanism and the expansion mechanism via the oil is suppressed, improving efficiency of the refrigeration cycle apparatus.

The expander-compressor unit of the present invention is a so-called high pressure shell type expander-compressor unit in which the discharge refrigerant from the compression mechanism is once released into an internal space of the closed casing, and then is discharged out of the closed casing. Accordingly, the expander-compressor unit of the present invention can separate sufficiently the oil from the discharge refrigerant from the compression mechanism, and thereby has no possibility of having oil shortage.

Moreover, unlike in the conventional example (see FIG. 11) in which the interior of the closed casing is partitioned into the high pressure side space and the low pressure side space, the expander-compressor unit of the present invention does not require a special structure around the shaft, such as the mechanical seal for preventing the refrigerant leakage between the high pressure side space and the low pressure side space. Therefore, there arises no problem of an increased mechanical loss of the shaft resulting from the mechanical seal, either.

As described above, the present invention can suppress the discharge amount of oil as well as reduce the heat transfer between the compression mechanism and the expansion mechanism without increasing the mechanical loss.

BEST MODE FOR CARRYING OUT THE INVENTION

Hereinbelow, embodiments of the present invention will be described with reference to the accompanying drawings.

Embodiment 1

Figure 1:
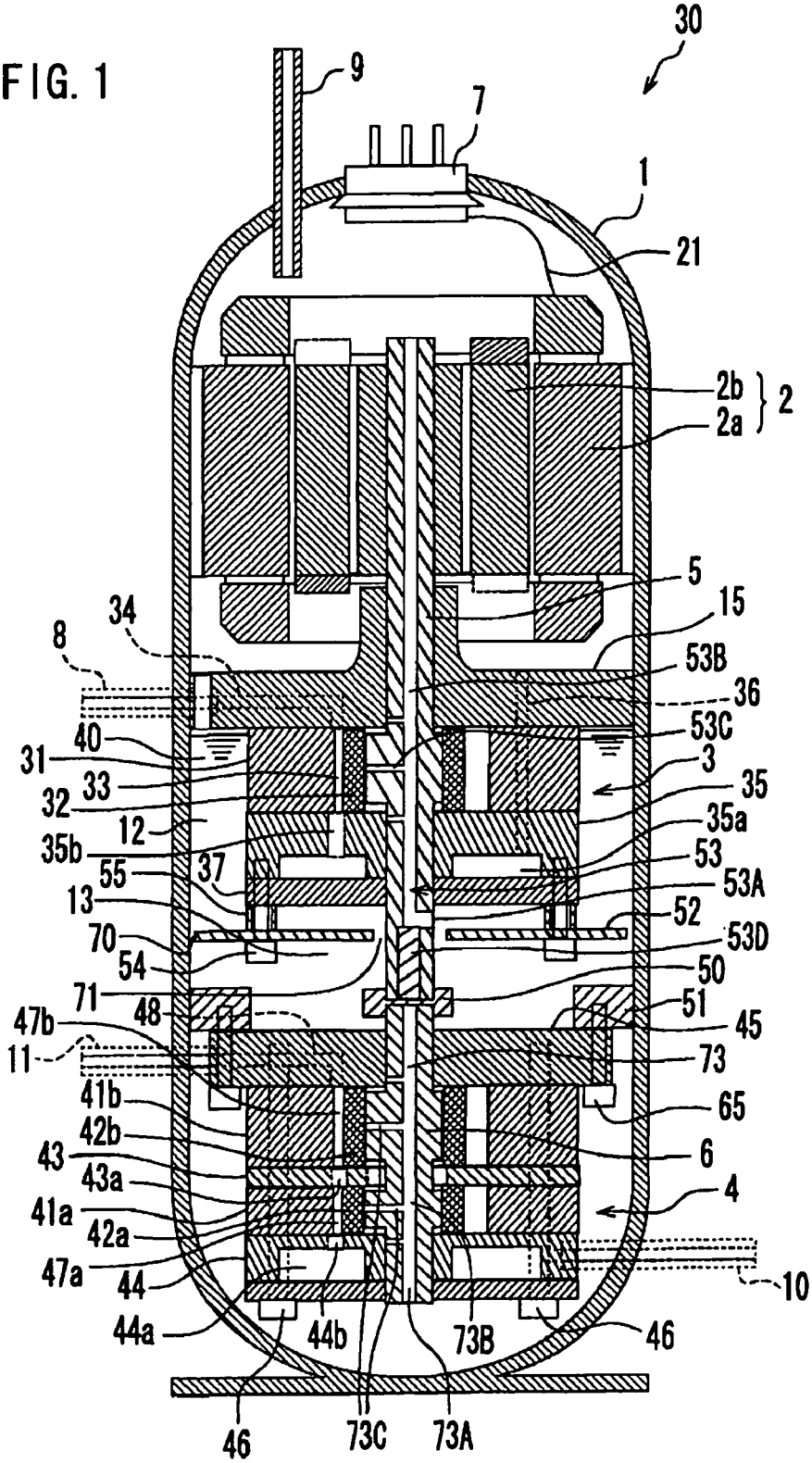
FIG. 1 is a vertical cross-sectional view of the expander-compressor unit according to Embodiment 1 of the present invention.
Figure 2:
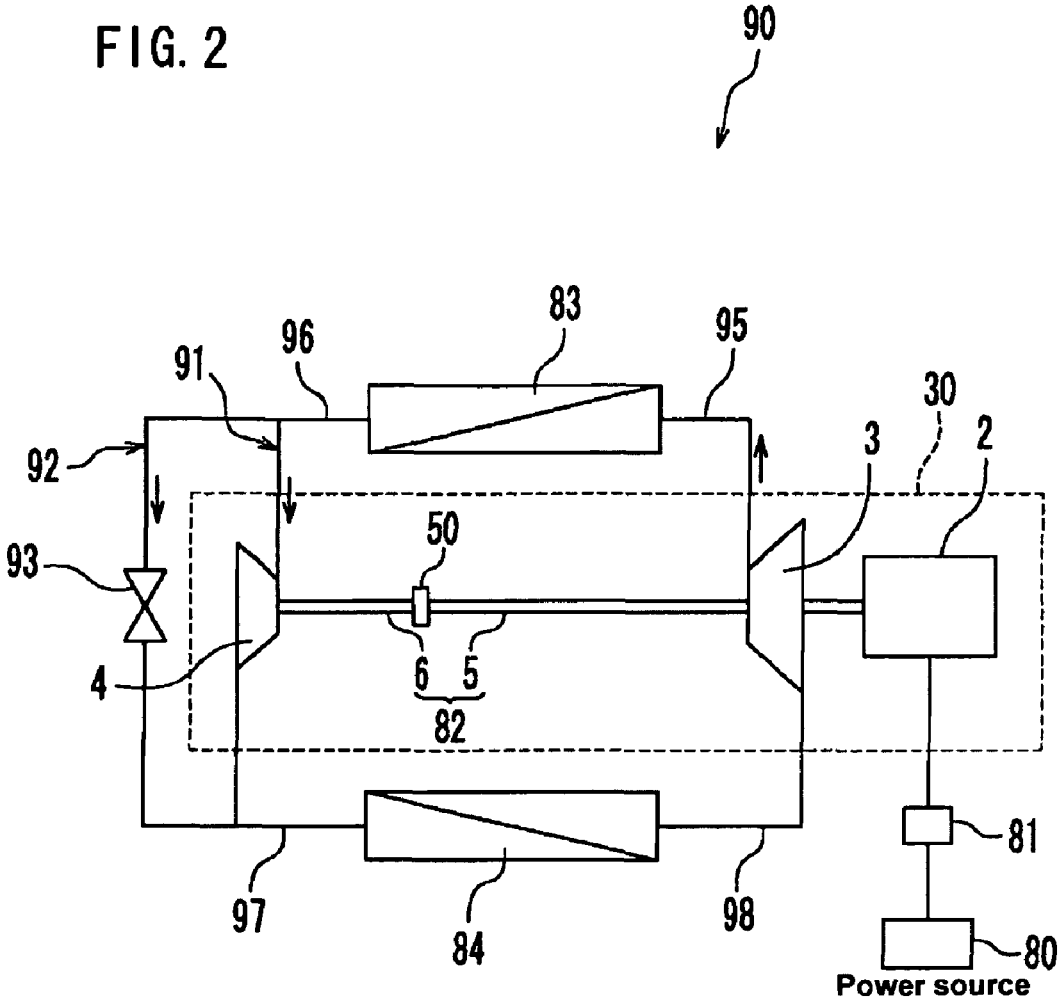
FIG. 2 is a configuration diagram of the refrigeration cycle apparatus according to the present invention.

FIG. 1 is a vertical cross-sectional view of an expander-compressor unit 30 according to Embodiment 1 of the present invention. FIG. 2 shows a refrigeration cycle apparatus 90 having the expander-compressor unit 30.

As shown in FIG. 1, the expander-compressor unit 30 includes a motor 2 operating in response to electric power supply from a commercial power source 80 (see FIG. 2), a compression mechanism 3 for compressing a refrigerant, an expansion mechanism 4 for allowing the refrigerant to expand, and a closed casing 1 accommodating these elements 2, 3, and 4. The motor 2, the compression mechanism 3, and the expansion mechanism 4 are disposed in this order from top to bottom. An oil 40 for lubricating the sliding parts of the compression mechanism 3 and the expansion mechanism 4 is held at a bottom portion of the closed casing 1 (it should be noted that the "bottom portion" here means a lower side with respect to an arbitrary predetermined position, and does not necessarily mean an absolute position. Accordingly, when the predetermined position is higher than a mid-position of the closed casing 1 in a vertical direction, a position higher than the mid-position also is included in the "bottom portion"). More specifically, a lower side of the closed casing 1 is used as an oil reserving portion (an oil reservoir) 12.

The motor 2 has a stator 2*a* attached to an inner peripheral surface of the closed casing 1, and a rotor 2*b* disposed inside of the stator 2*a*. A compression mechanism side shaft 5 is fixed to the rotor 2*b*. The compression mechanism side shaft 5 is supported rotatably at a middle portion thereof by a bearing member 15. A terminal 7 is provided at a top portion of the closed casing 1. The stator 2*a* is connected to the terminal 7 via an electric wire 21.

The motor 2 (specifically, the rotor 2*b*) and the compression mechanism 3 are connected to each other via the compression mechanism side shaft 5 in such a manner that mechanical power can be transferred therebetween. The compression mechanism 3 of the present embodiment is a rotary compression mechanism having a cylinder 31 and a piston 32. It should be noted, however, that the compression mechanism 3 of the present invention is not limited to rotary compression mechanisms, and it may be another rotating type compression mechanism. The specific configuration thereof is not limited in any way. A compression chamber 33 is formed between the cylinder 31 and the piston 32. A suction passage 34 for guiding the refrigerant from a suction pipe 8 to the compression chamber 33 is formed in the bearing member 15. A lower bearing member 35 is provided below the cylinder 31. A muffler space 35*a* and a flow passage 35*b* are formed in the lower bearing member 35. The flow passage 35*b* guides the refrigerant compressed in the compression chamber 33 to the muffler space 35*a*. A discharge passage 36 extending in the vertical direction is formed in the lower bearing member 35, the cylinder 31, and the bearing member 15. The discharge passage 36 discharges above the bearing member 15 the refrigerant in the muffler space 35*a*. A closing plate 37 is disposed under the lower bearing member 35, and closes the muffler space 35*a* from a lower side thereof.

The expansion mechanism 4 of the present embodiment is a two-stage rotary expansion mechanism having two cylinders 41*a* and 41*b* and two pistons 42*a* and 42*b*. It should be noted, however, that the expansion mechanism 4 of the present invention is not limited to rotary expansion mechanisms, and it may be another rotating type expansion mechanism. The specific configuration thereof is not limited in any way. A lower bearing member 44 is disposed below the lower cylinder 41*a*. A partition member 43 is provided between the lower cylinder 41*a* and the upper cylinder 41*b*. A bearing member 45 is provided above the upper cylinder 41*b*. The lower bearing member 44, the lower cylinder 41*a*, the partition member 43, the upper cylinder 41*b*, and the bearing member 45 are fixed integrally with bolts 46. A muffler space 44*a* and a communication port 44*b* are formed in the lower bearing member 44. A suction pipe 10 penetrates through a lower portion of the closed casing 1, and is connected to the lower bearing member 44. The suction pipe 10 introduces the suction refrigerant into the muffler space 44*a*. A first expansion chamber 47*a* is formed between the lower cylinder 41*a* and the piston 42*a*. The first expansion chamber 47*a* is in communication with the muffler space 44*a* via the communication port 44*b*. A second expansion chamber 47*b* is formed between the upper cylinder 41*b* and the piston 42*b*. A communication passage 43*a* is formed in the partition member 43, and the first expansion chamber 47*a* and the second expansion chamber 47*b* are in communication with each other via the communication passage 43*a*. A discharge passage 48 for guiding the refrigerant from the second expansion chamber 47*b* to a discharge pipe 11 is formed in the bearing member 45. In the expansion mechanism 4 of the present embodiment, the first expansion chamber 47*a*, the communication passage 43*a*, and the second expansion chamber 47*b* as a whole form one expansion chamber that performs a suction process, an expansion process, and a discharge process of the refrigerant.

In the present embodiment, the upper cylinder 41*b* has an inner diameter equal to that of the lower cylinder 41*a*, and furthermore, the upper cylinder 41*b* has a height (a thickness in the vertical direction) larger than that of the lower cylinder 41*a*. Thereby, the second expansion chamber 47*b* has a volumetric capacity larger than that of the first expansion chamber 47*a*. The configuration for making the volumetric capacity of the second expansion chamber 47*b* larger than the volumetric capacity of the first expansion chamber 47*a* is not limited to this. For example, it is possible to employ a configuration in which the upper cylinder 41*b* has a height equal to that of the lower cylinder 41*a*, and furthermore, the upper cylinder 41*b* has an inner diameter larger than that of the lower cylinder 41*a*.

An expansion mechanism side shaft 6 rotating in accordance with rotation of the pistons 42*a* and 42*b* is provided in the expansion mechanism 4. The expansion mechanism side shaft 6 is coupled to the compression mechanism side shaft 5 via a coupling mechanism 50. Specific configuration of the coupling mechanism 50 is not particularly limited. For example, a disk-like member suitably can be used to be spline-fitted to each of the compression mechanism side shaft 5 and the expansion mechanism side shaft 6.

The compression mechanism 3 and the expansion mechanism 4 are disposed separated from each other in the vertical direction. A buffer space 13 filled with the oil 40 is formed between the compression mechanism 3 and the expansion mechanism 4 in the closed casing 1.

An oil supply passage 53 for guiding the oil held in the oil reserving portion 12 to the sliding parts of the compression mechanism 3 is formed in the compression mechanism side shaft 5. The oil supply passage 53 includes an oil suction port (an oil suction portion) 53A, which faces the buffer space 13, for drawing the oil at a portion of the compression mechanism side shaft 5, the portion being above the coupling mechanism 50, a vertical flow passage 53B penetrating through a center of the compression mechanism side shaft 5, and an oil supply port 53C for supplying the oil in the vertical flow passage 53B to the sliding parts. Specifically, a through hole is formed in the compression mechanism side shaft 5. The through hole extends in an axial direction of the compression mechanism side shaft 5. A stopper member 53D is inserted into a lower end portion of the compression mechanism side shaft 5, and a lower side of the through hole is closed by the stopper member 53D. The lateral port 53A is formed at a lower side of the compression mechanism side shaft 5, and the horizontal port 53A constitutes the oil suction port for drawing the oil at the portion above the coupling mechanism 50. In the present embodiment, the oil suction port 53A opens in a horizontal direction. It should be noted, however, that the opening direction of the oil suction port 53A is not limited, and it may open in a direction inclined from the horizontal direction, for example. The vertical flow passage 53B has only to open at least downward, not necessarily have to penetrate through the compression mechanism side shaft 5.

A flow suppressing plate 52 is provided in the buffer space 13 at a position below the oil suction port 53A. The flow suppressing plate 52 is formed in an approximately annular shape, and has an outer diameter slightly smaller than an inner diameter of the closed casing 1. Thereby, a clearance 70 is formed between an outer peripheral surface of the flow suppressing plate 52, and the inner peripheral surface of the closed casing 1. A hole 71 into which the compression mechanism side shaft 5 is inserted is formed at a center of the flow suppressing plate 52A. This hole prevents the flow suppressing plate 52 from interfering with the compression mechanism side shaft 5. The flow suppressing plate 52 is fixed to the compression mechanism 3 with bolts 54, with a spacer 55 being interposed between the compression mechanisms 3 and the flow suppressing plate 52.

A cylindrical fixing member 51 is fixed to the closed casing 1 at a position below the flow suppressing plate 52 by a method such as welding and shrink fitting. The expansion mechanism 4 is fixed to the fixing member 51 with bolts 65. A cut-out (not shown) for returning oil is provided in the fixing member 51.

An oil supply passage 73 for guiding the oil to the sliding parts of the expansion mechanism 4 is provided in the expansion mechanism side shaft 6. The oil supply passage 73 includes an oil suction port 73A for drawing the oil from beneath the expansion mechanism side shaft 6, a vertical flow passage 73B penetrating through a center of the expansion mechanism side shaft 6, and an oil supply port 73C for supplying the oil in the vertical flow passage 73B to the sliding parts.

As shown in FIG. 2, the refrigeration cycle apparatus 90 includes a main refrigerant circuit 91 constituted by connecting in a circuit the compression mechanism 3 of the expander-compressor unit 30, a radiator 83, the expansion mechanism 4, and an evaporator 84 in this order, as well as a bypass circuit 92 for bypassing the expansion mechanism 4. The compression mechanism 3 and the radiator 83 are connected to each other by a first pipe 95. The radiator 83 and the expansion mechanism 4 are connected to each other by a second pipe 96. The expansion mechanism 4 and the evaporator 84 are connected to each other by a third pipe 97. The evaporator 84 and the compression mechanism 3 are connected to each other by a fourth pipe 98. A flow rate adjustable valve 93 is provided in the bypass circuit 92. An inverter 81 is provided between the power source 80 and the motor 2. The compression mechanism side shaft 5 and the expansion mechanism side shaft 6 are coupled to each other by the coupling mechanism 50 so as to constitute a shaft 82 that rotates integrally.

Next, operation of the expander-compressor unit 30 of the present embodiment will be described.

Electric power supplied from the commercial power source 80 is supplied to the motor 2 via the inverter 81 and the terminal 7. Thereby, the motor 2 is driven. Rotational mechanical power generated at the motor 2 is transferred to the compression mechanism 3 by the compression mechanism side shaft 5, and drives the compression mechanism 3.

The compression mechanism 3 draws the low pressure refrigerant via the suction pipe 8 and compresses it, and then discharges the compressed, high temperature, high pressure refrigerant to the interior of the closed casing 1. The refrigerant discharged to the interior of the closed casing 1 is discharged out of the closed casing 1 via a discharge pipe 9. More specifically, the refrigerant drawn via the suction pipe 8 is guided to the compression chamber 33 through the suction passage 34, and is compressed in the compression chamber 33. The compressed refrigerant flows through the flow passage 35*b*, the muffler space 35*a*, and the discharge passage 36 in this order, and is discharged above the bearing member 15. The refrigerant discharged above the bearing member 15 flows around the motor 2, and then is discharged out of the closed casing 1 via the discharge pipe 9.

The refrigerant discharged via the discharge pipe 9 is guided to the radiator 83 through the first pipe 95 (see FIG. 2). The refrigerant radiates heat at the radiator 83 (see FIG. 2) to be cooled, and is guided to the expansion mechanism 4 via the second pipe 96 and the suction pipe 10.

The expansion mechanism 4 allows the refrigerant entering thereinto via the suction pipe 10 to expand. At this time, the expansion mechanism 4 converts expansion energy of the refrigerant into rotational mechanical power and recovers it, and rotates the expansion mechanism side shaft 6. Since the expansion mechanism side shaft 6 is coupled to the compression mechanism side shaft 5 via the coupling mechanism 50, the mechanical power of the expansion mechanism side shaft 6 is transferred to the compression mechanism side shaft 5. In this way, the expansion mechanism 4 superimposes the mechanical power derived from the expansion energy on the mechanical power of the motor 2 driving the compression mechanism 3, via the expansion mechanism side shaft 6, the coupling mechanism 50, and the compression mechanism side shaft 5. Specifically, the refrigerant drawn via the suction pipe 10 is guided to the first expansion chamber 47*a* through the muffler space 44*a* and the communication port 44*b*, and expands in the first expansion chamber 47*a*, the communication passage 43*a*, and the second expansion chamber 47*b*. The refrigerant having expanded reaches the discharge pipe 11 from the second expansion chamber 47*b* through the discharge passage 48, and is discharged via the discharge pipe 11.

The low pressure refrigerant discharged via the discharge pipe 11 passes through the third pipe 97, and then is heated in the evaporator 84 to evaporate (see FIG. 2). The refrigerant having flowed out of the evaporator 84 is guided by the fourth pipe 98 and the suction pipe 8, and again is drawn into the compression mechanism 3 to be compressed.

The aforementioned operation increases a temperature of the compression mechanism 3 while decreasing that of the expansion mechanism 4. More specifically, since the compression mechanism 3 adiabatically compresses the refrigerant that has turned into low pressure vapor by passing through the evaporator 84, the temperature of the refrigerant during a compression process in the compression mechanism 3 rises as the pressure increases. This makes the temperature of the compression mechanism 3 high. On the other hand, since the expansion mechanism 4 adiabatically expands the refrigerant whose temperature has been lowered by passing through the radiator 83, the temperature of the refrigerant during a expansion process in the expansion mechanism 4 lowers as the pressure decreases. This makes the temperature of the expansion mechanism 4 low. To the interior of the closed casing 1, the high temperature, high pressure refrigerant from the compression mechanism 3 is discharged. The motor 2 loses a part of input power due to iron loss, copper loss, etc., and produces heat when generating the rotational mechanical power for driving the compression mechanism 3.

In the expander-compressor unit 30 of the present embodiment, the motor 2, which produces heat and has the highest temperature, is disposed at an upper part of the closed casing 1, the compression mechanism 3, which has a high temperature, is disposed in the middle, and the expansion mechanism 4, which has a low temperature, is disposed at a lower part of the closed casing 1. More specifically, the motor 2, the compression mechanism 3, and the expansion mechanism 4 are disposed from top to bottom in descending order of temperature. Thereby, natural convection of the refrigerant and the oil is suppressed in the closed casing 1, and a stratified temperature-distribution is formed in the refrigerant and oil in the closed casing 1. Thus, heat transfer via the internal fluid (the refrigerant or the oil) is suppressed among the motor 2, the compression mechanism 3, and the expansion mechanism 4.

In the expander-compressor unit 30, the oil suction port 53A for the compression mechanism 3 is provided on the compression mechanism side shaft 5 located above the coupling mechanism 50. Since the oil is temperature-stratified as described above, the oil present higher than the coupling mechanism 50 has a temperature higher than that of the oil present lower than the coupling mechanism 50. Thus, according to the present embodiment, the relatively high temperature oil can be supplied to the high temperature compression mechanism 3. This makes it possible to suppress the heat transfer between the compression mechanism 3 and the expansion mechanism 4 via the oil.

In the expander-compressor unit 30, the oil suction port 73A for the expansion mechanism 4 is provided in the vicinity of a lower end portion of the closed casing 1. Thus, the relatively low temperature oil can be supplied to the low temperature expansion mechanism 4. This also makes it possible to suppress the heat transfer between the compression mechanism 3 and the expansion mechanism 4 via the oil.

In this way, in the expander-compressor unit 30, an oil circulation on a side of the compression mechanism 3 located at the upper part, and an oil circulation on a side of the expansion mechanism 4 located at the lower part are formed in the closed casing 1. More specifically, a circulation is formed on each of the compression mechanism 3 side and the expansion mechanism 4 side separately.

In the expander-compressor unit 30, the refrigerant compressed by the compression mechanism 3 is once discharged to the interior of the closed casing 1, and then is discharged out of the closed casing 1 via the discharge pipe 9. Accordingly, the oil contained in the discharge refrigerant is separated from the discharge refrigerant while the discharge refrigerant passes through the interior of the closed casing 1. As a result, it is possible to suppress the oil contained in the discharge refrigerant from flowing out of the closed casing 1, and to avoid oil shortage in the closed casing 1.

The expander-compressor unit 30 does not require the interior of the closed casing 1 to be partitioned into a high pressure side space and a low pressure side space. Therefore, it is not necessary to provide a special structure around the shaft 5, such as a mechanical seal for preventing refrigerant leakage between the high pressure side space and the low pressure side space. There is no possibility for the shaft 5 to have a mechanical loss resulting from the mechanical seal etc.

In the expander-compressor unit 30, the shaft 82 has the compression mechanism side shaft 5 and the expansion mechanism side shaft 6, and the compression mechanism side shaft 5 and the expansion mechanism side shaft 6 are coupled to each other via the coupling mechanism 50. This makes it possible to assemble the compression mechanism 3 with the compression mechanism side shaft 5, and assemble the expansion mechanism 4 with the expansion mechanism side shaft 6 separately, and thereafter couple them with the coupling mechanism 50. Thus, the whole structure can be assembled. This makes the assembly easier, leading to an improved productivity.

In the expander-compressor unit 30, the buffer space 13 filled with the oil is provided between the compression mechanism 3 and the expansion mechanism 4. This makes it possible to prevent the compression mechanism 3 from contacting the expansion mechanism 4 directly, avoiding heat conduction between the compression mechanism 3 and the expansion mechanism 4.

Furthermore, since the coupling mechanism 50 is disposed in the buffer space 13 in the expander-compressor unit 30, the oil in the buffer space 13 sufficiently can lubricate the coupling mechanism 50.

In the expander-compressor unit 30, the flow suppressing plate 52 is provided at a position below the oil suction port 53A in the buffer space 13. Therefore, even when rotation of the motor 2 causes a revolving flow of the refrigerant in the closed casing 1, and the high temperature oil on the compression mechanism 3 side flows in accordance with this, mixing of the high temperature oil with the low temperature oil present below the flow suppressing plate 52 is suppressed. More specifically, even when the high temperature oil present above the flow suppressing plate 52 flows, there is no possibility that the low temperature oil present below the flow suppressing plate 52 is stirred strongly because the flow of the high temperature oil is isolated by the flow suppressing plate 52. In this way, mixing of the high temperature oil with the low temperature oil can be suppressed, and the heat transfer between the compression mechanism 3 and the expansion mechanism 4 via the oil can be suppressed effectively. Furthermore, the oil suction port 53A can take in the high temperature oil that is above the flow suppressing plate 52.

Moreover, the flow suppressing plate 52 is a plate of an approximately annular shape having a size that allows the clearance 70 to be formed between itself and the inner peripheral surface of the closed casing 1. The flow suppressing plate 52 has, at the center thereof, the hole 71 for avoiding interference with the compression mechanism side shaft 5. Since the flow suppressing plate 52 thus configured is fixed to the compression mechanism 3 using the bolts 54 and the spacer 55 in the present embodiment, the compression mechanism side shaft 5 can rotate smoothly, and employing the flow suppressing plate 52 causes no excessive mechanical loss. Also, the heat transfer between the compression mechanism 3 and the expansion mechanism 4 can be suppressed with the simple, inexpensive configuration. More specifically, the heat transfer between the compression mechanism 3 and the expansion mechanism 4 via the oil can be suppressed by employing the simple, inexpensive configuration in which the approximately circular plate is fixed simply to the compression mechanism 3 with the bolts 54 and the spacer 55.

The expander-compressor unit 30 of the present embodiment includes the vertical flow passage 53B penetrating through a central axis of the compression mechanism side shaft 5, the oil suction port 53A communicating with the vertical flow passage 53B at the portion of the compression mechanism side shaft 5, the portion being above the coupling mechanism 50, the oil supply port 53C leading from the vertical flow passage 53B to the sliding parts of the compression mechanism 3, and the stopper member 53D for closing a lower end of the vertical flow passage 53B. Thus, an oil supply passage to the compression mechanism 3 can be formed by the simple work of forming laterally the oil suction port 53A and the oil supply port 53C in the compression mechanism side shaft 5 having the vertical flow passage 53B, and closing the end of the vertical flow passage 53B with the stopper member 53D. Furthermore, since the stopper member 53D closes the end of the vertical flow passage 53B, the relatively low temperature oil near the coupling mechanism 50 and the expansion mechanism side shaft 6 is not used as the oil for lubricating the compression mechanism 3. Thereby, the heat transfer between the compression mechanism 3 and the expansion mechanism 4 can be suppressed.

In the expander-compressor unit 30, the expansion mechanism 4 is fixed, with the bolts 65, to the cylindrical fixing member 51 that is fixed to the closed casing 1 by welding or shrink fitting. This separates substantially the compression mechanism 3 from the expansion mechanism 4. Accordingly, between the compression mechanism 3 and the expansion mechanism 4, the coupling mechanism 50 and the closed casing 1 are the only elements of the heat transfer caused by heat conduction. Thereby, influence of the heat transfer caused by heat conduction can be reduced better in this case than in the case of merely fastening the compression mechanism 3 to the expansion mechanism 4 with bolts and a spacer. It is desirable for the cylindrical fixing member 51 to be in contact with the closed casing 1 in a smaller area. For this purpose, a cut-out(s), or a depression(s) and a projection(s) may be formed in an outer peripheral portion of the fixing member 51, for example, so that the fixing member 51 is in contact with the closed casing 1 at a point or on a line. The cut-out, or the depression and the projection functions as a flow passage for returning the oil.

The flow suppressing plate 52 is fixed to the compression mechanism 3 in the present embodiment. It also is possible, however, to fix the flow suppressing plate 52 to the expansion mechanism 4.

Embodiment 2

Figure 3:
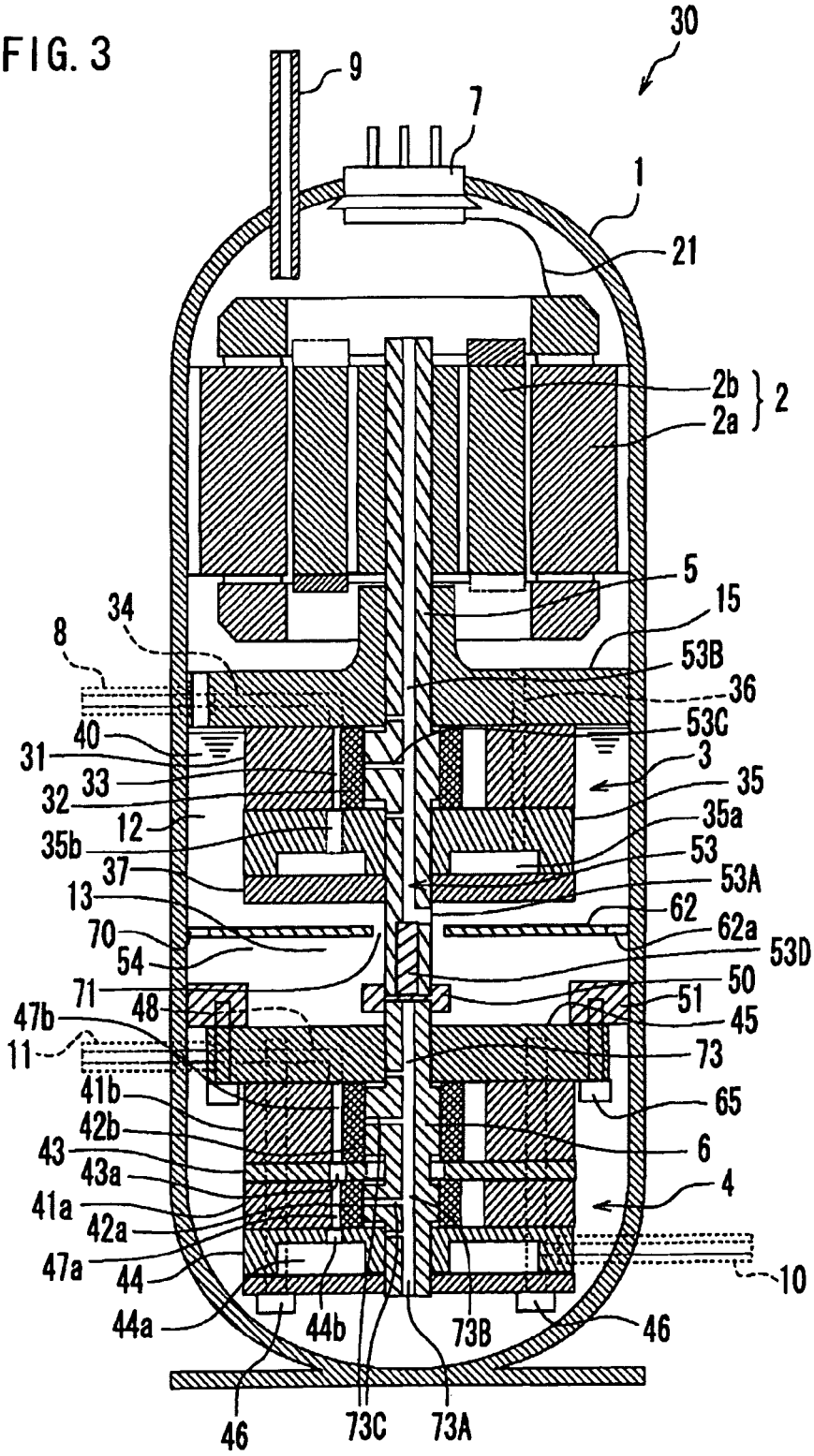
FIG. 3 is a vertical cross-sectional view of the expander-compressor unit according to Embodiment 2 of the present invention.

FIG. 3 is a vertical cross-sectional view of the expander-compressor unit 30 according to Embodiment 2 of the present invention. As shown in FIG. 3, the expander-compressor unit 30 of the present embodiment has almost the same configuration as that of the expander-compressor unit described in Embodiment 1 (see FIG. 1). Hereinbelow, components having the same functions are indicated by the same reference numerals, and explanations thereof are omitted.

A difference between the present embodiment and Embodiment 1 is the shape of the flow suppressing plate 62. The flow suppressing plate 62 of the present embodiment is a cut-out plate of an approximately annular shape having cut-outs 62*a* in an outer peripheral portion thereof. The cut-outs 62*a* intermittently are formed along the outer periphery of the flow suppressing plate 62. The number of the cut-outs 62*a* is not particularly limited. The flow suppressing plate 62 of the present embodiment also has the hole 71 at its center in such a manner that the flow suppressing plate 62 does not interfere with the compression mechanism side shaft 5.

The flow suppressing plate 62 of the present embodiment is fixed to the inner peripheral surface of the closed casing 1 by shrink fitting or welding. The flow suppressing plate 62 is not fastened directly to the high temperature compression mechanism 3 with bolts and a spacer. Accordingly, between the compression mechanism 3 and the flow suppressing plate 62, the closed casing 1 is the only element of the heat transfer caused by heat conduction in the present embodiment. Thereby, influence of the downward heat transfer caused by heat conduction can be reduced better in this case than in the case of merely fastening the flow suppressing plate 62 to the compression mechanism 3 with bolts and a spacer.

Since the cut-outs 62*a* are provided in the outer peripheral portion of the flow suppressing plate 62, a contact surface between the flow suppressing plate 62 and the closed casing 1 is limited relatively small. Thereby, heat conduction from the closed casing 1 to the flow suppressing plate 62 can be suppressed.

In the present embodiment, the flow suppressing plate 62 is provided with the cut-outs 62*a* in the outer peripheral portion thereof so as to have recessed portions recessed inward in a radial direction. However, the specific shape of the recessed portions is not limited in any way, and a similar effect also can be achieved by forming a depression and a projection in the outer peripheral portion of the flow suppressing plate 62. As described above, it is desirable for the flow suppressing plate 62 to be in contact with the closed casing 1 in a smaller area. It may be in contact with the closed casing 1 at a point or on a line.

Embodiment 3

Figure 4:
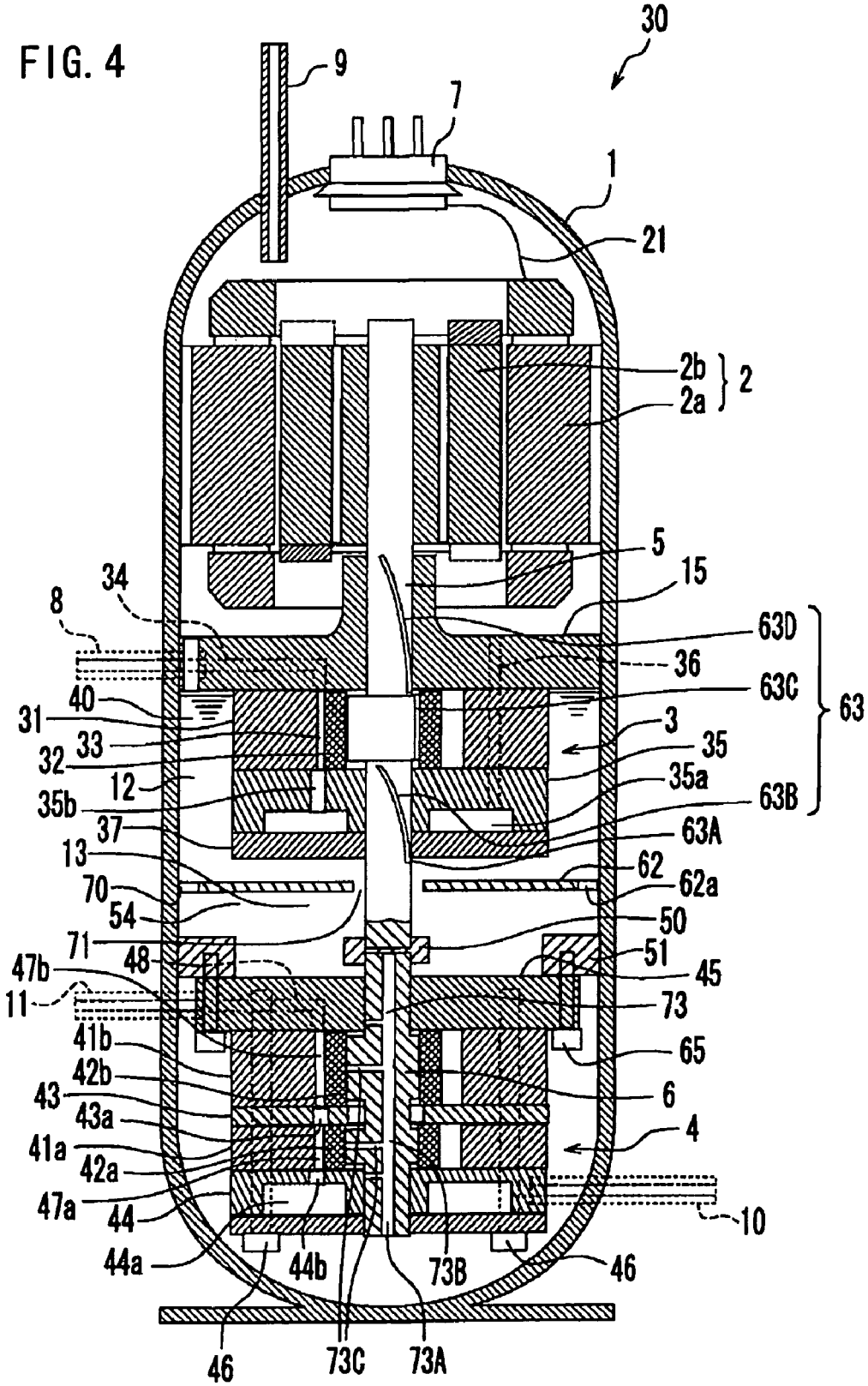
FIG. 4 is a vertical cross-sectional view of the expander-compressor unit according to Embodiment 3 of the present invention.

FIG. 4 is a vertical cross-sectional view of the expander-compressor unit 30 according to Embodiment 3 of the present invention. As shown in FIG. 4, the expander-compressor unit 30 of the present embodiment has almost the same configuration as that of the expander-compressor unit described in Embodiment 2 (see FIG. 3). Hereinbelow, components having the same functions are indicated by the same reference numerals, and explanations thereof are omitted.

A difference between the present embodiment and Embodiment 2 is the configuration of the oil supply passage. An oil supply passage 63 of the present embodiment includes oil grooves 63B, 63C and 63D formed in the outer peripheral surface of the compression mechanism side shaft 5, and continuous passages (not shown) bringing them into communication with each other. The oil grooves 63B and 63D are formed in the outer peripheral surface of the compression mechanism side shaft 5, at a portion higher than an eccentric portion of the compression mechanism side shaft 5 and at a portion lower than the eccentric portion of the compression mechanism side shaft 5, respectively. The oil grooves 63B and 63D extend vertically while being inclined (in a spiral shape, for example). The oil groove 63C formed in the outer peripheral surface of the eccentric portion of the compression mechanism side shaft 5 extends straight in the vertical direction. The continuous passage can be formed, for example, in a lower surface and an upper surface of the eccentric portion, or in the compression mechanism side shaft 5. A lower end portion 63A of the oil groove 63B constitutes the oil suction portion, and faces the buffer space 13. Instead of the oil grooves 63B and 63D, there may be formed an oil groove extending vertically in inner peripheral surfaces of the bearings each disposed above and below the compression mechanism 3 (each of the bearings has an inner peripheral surface facing the outer peripheral surface of the compression mechanism side shaft 5. For example, the bearings are the bearing member 15 and the lower bearing member 37). In this case, a lower end portion of the lower one of these grooves constitutes the oil suction portion.

The present embodiment makes it possible to form the oil supply passage 63 by the simple, inexpensive work of forming grooves in the outer peripheral surface of the compression mechanism side shaft 5 or in the bearings. Since the lower end portion 63A of the oil supply passage 63 faces the buffer space 13 right under the compression mechanism 3, it can draw the high temperature oil that is higher than the coupling mechanism 50 smoothly and reliably.

MODIFIED EXAMPLE

Figure 5:
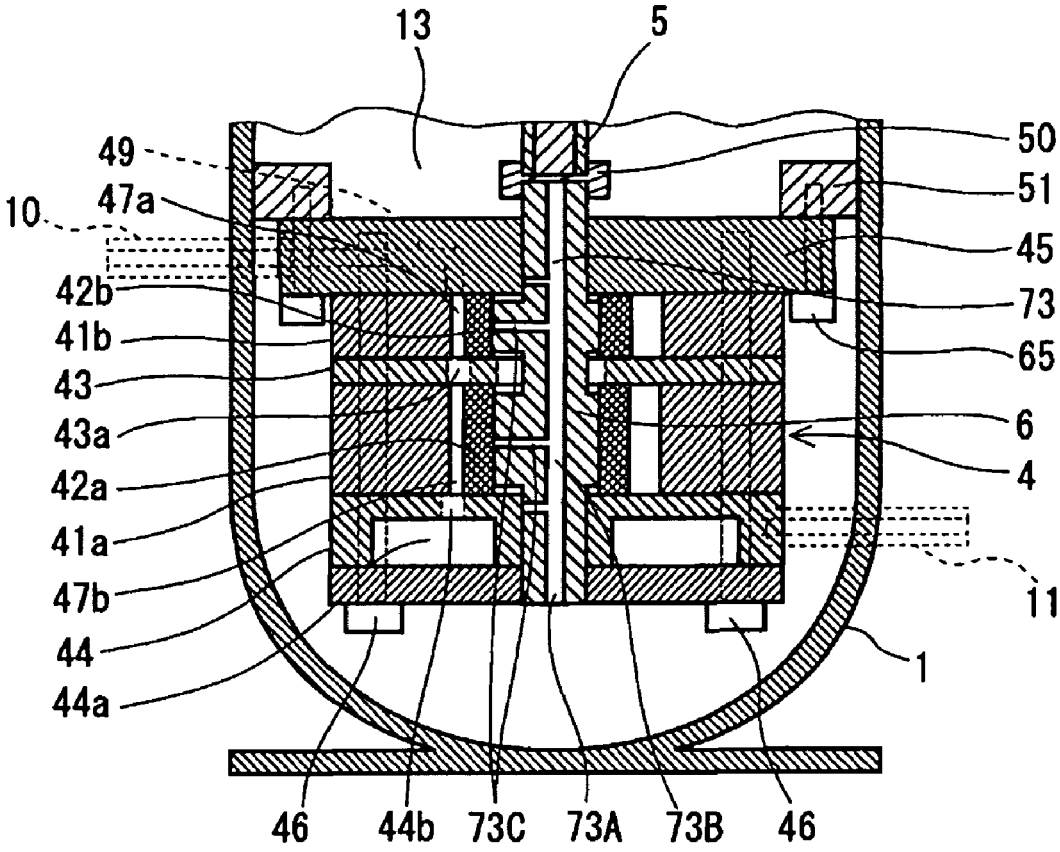
FIG. 5 is a partial vertical cross-sectional view of the expander-compressor unit according to Modified Example.
Figure 6:
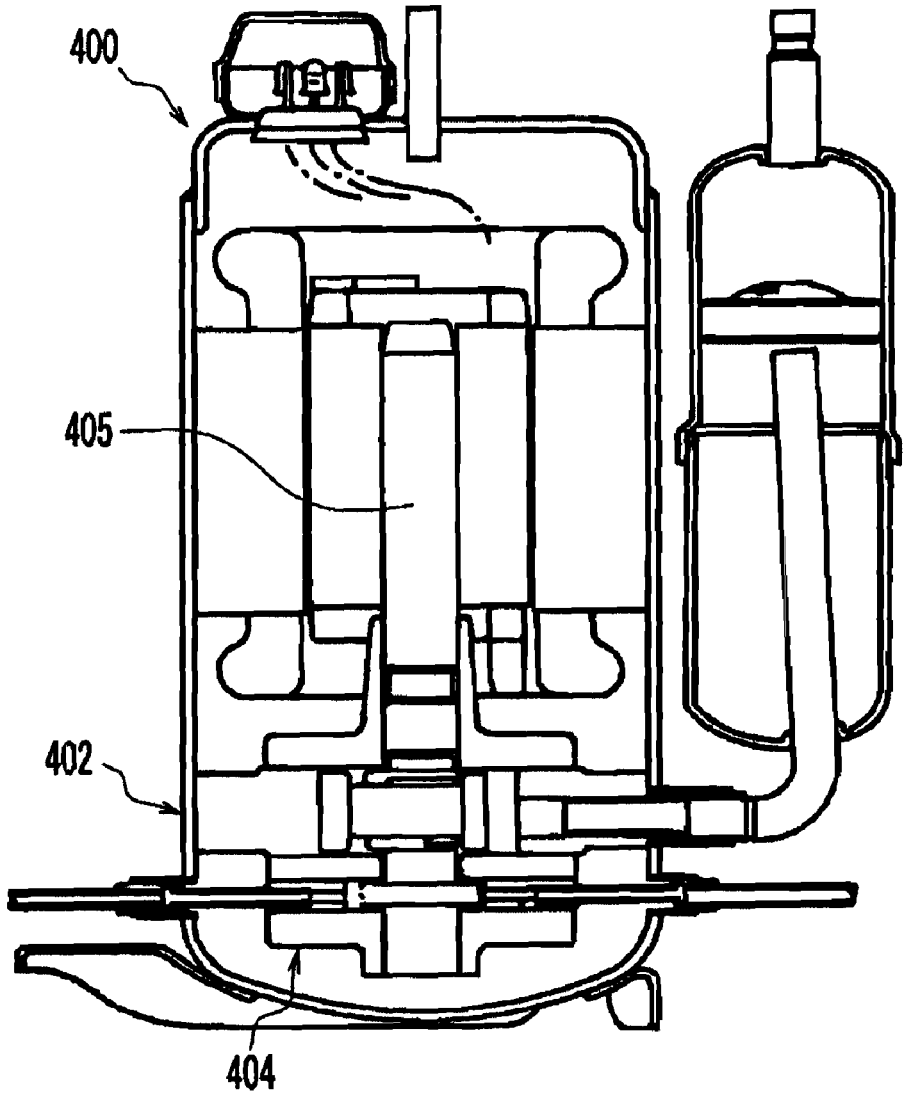
FIG. 6 PRIOR ART
FIG. 6 is a vertical cross-sectional view of a conventional expander-compressor unit.
Figure 7:
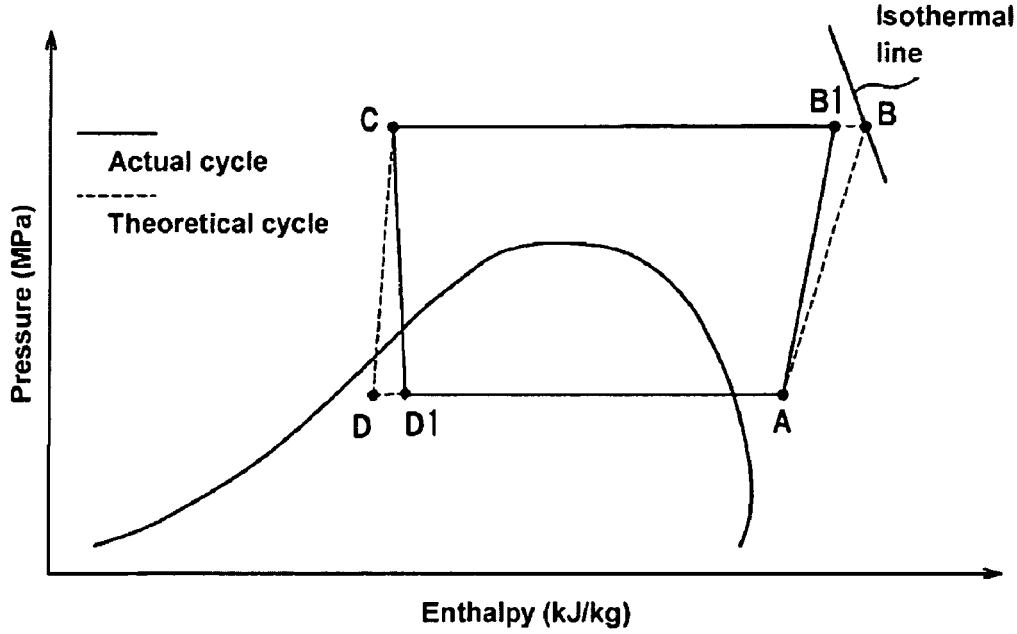
FIG. 7 is a Mollier diagram of a conventional refrigeration cycle apparatus.
Figure 8:
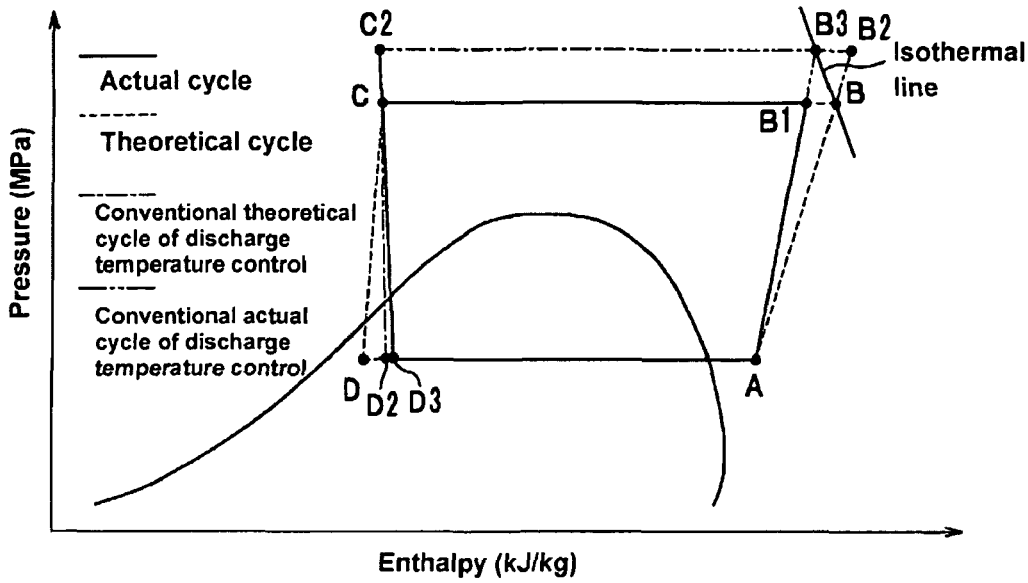
FIG. 8 is a Mollier diagram of the conventional refrigeration cycle apparatus.
Figure 9:
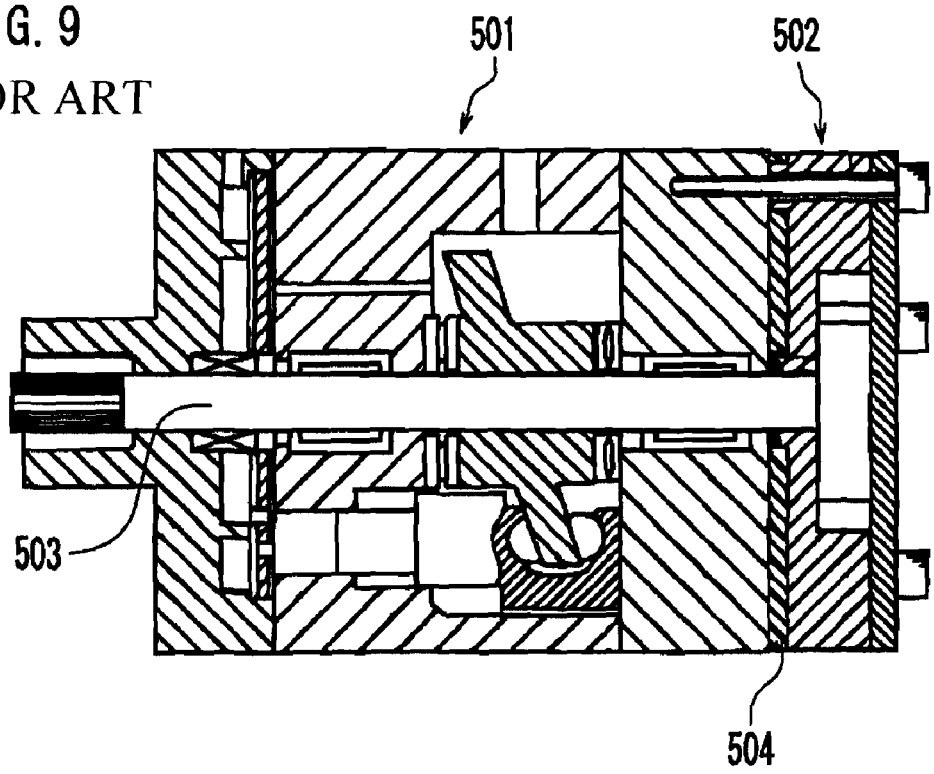
FIG. 9 PRIOR ART
FIG. 9 is a vertical cross-sectional view of a conventional expander-compressor unit.
Figure 10:
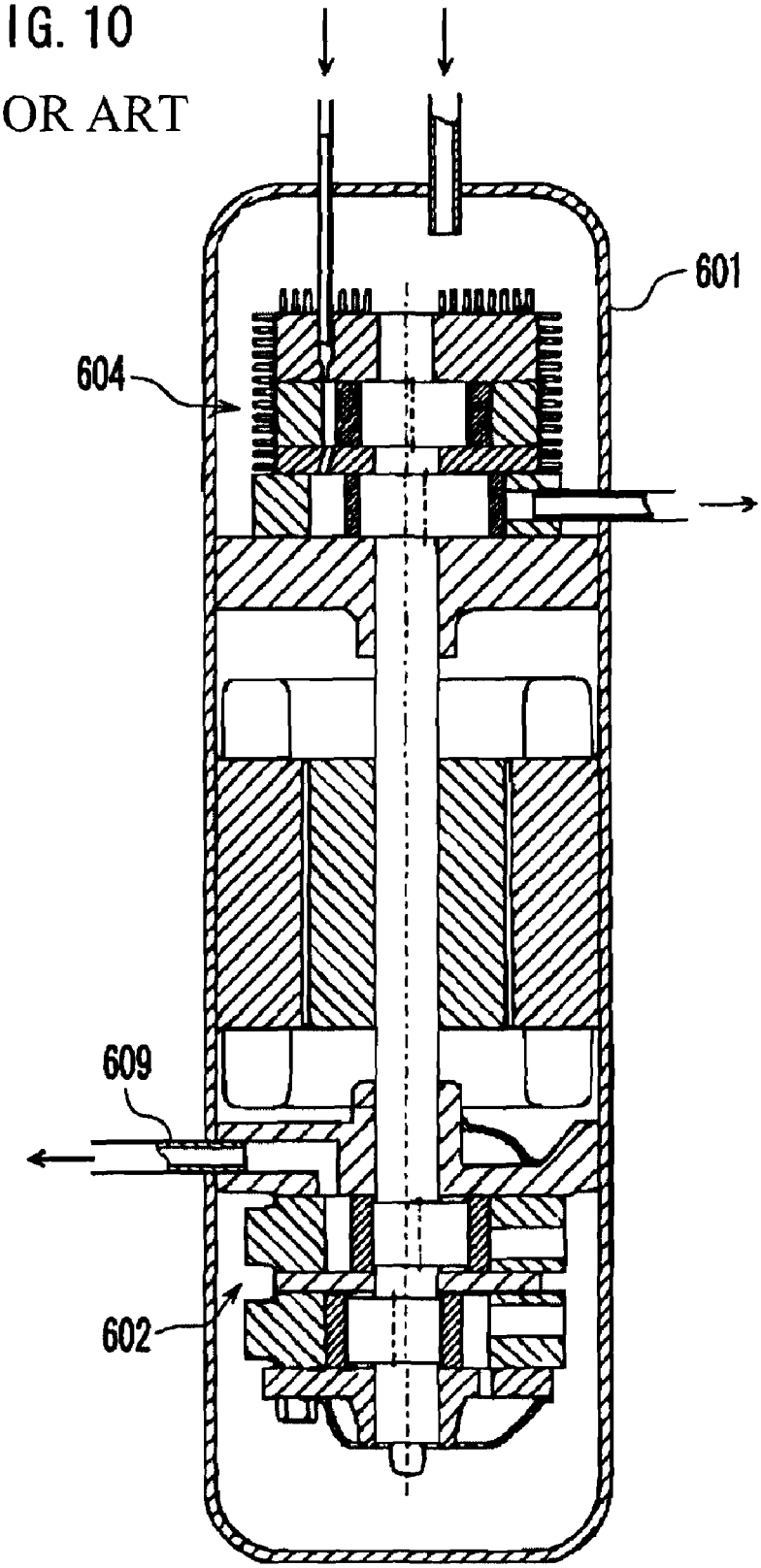
FIG. 10 PRIOR ART
FIG. 10 is a vertical cross-sectional view of a conventional expander-compressor unit.
Figure 11:
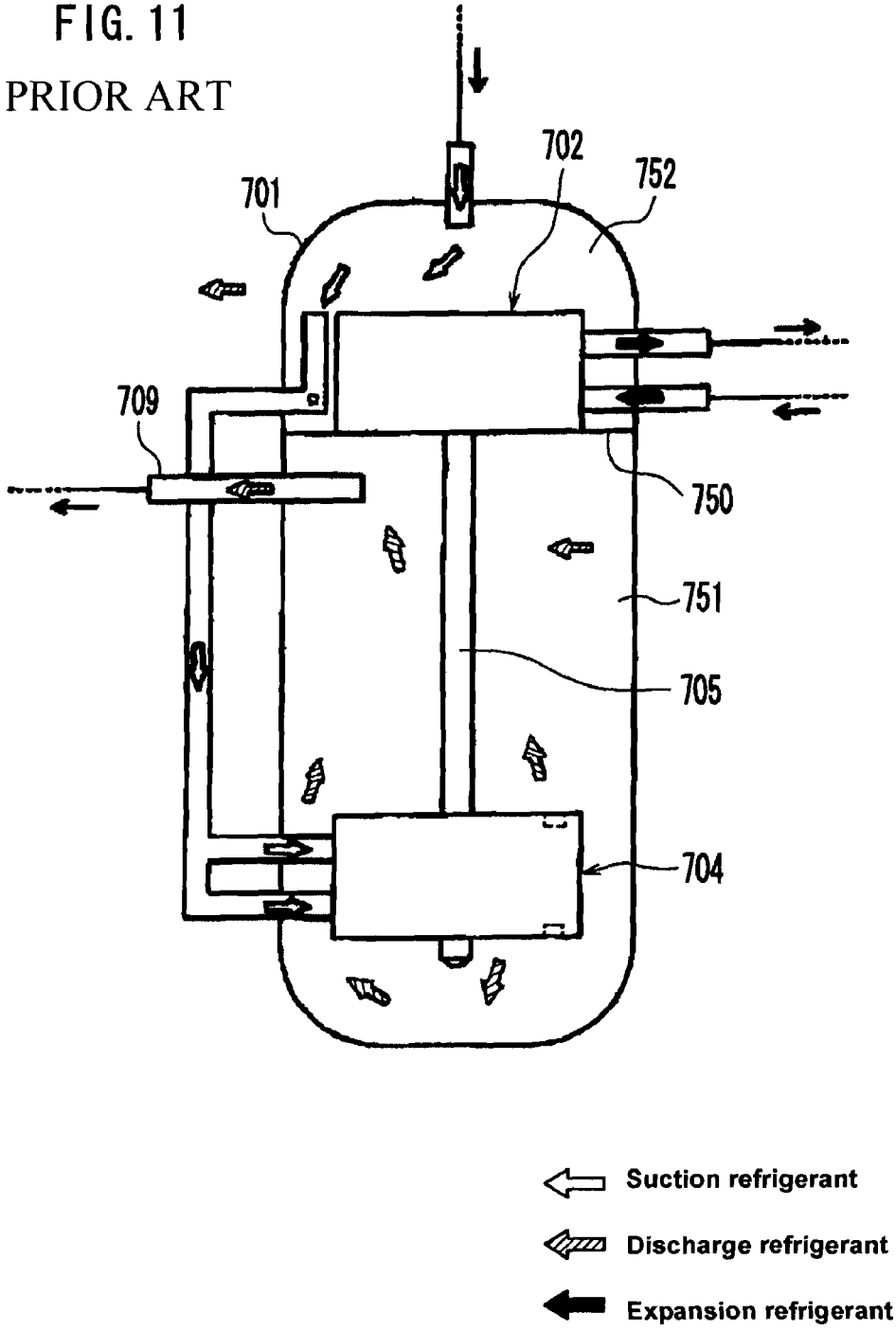
FIG. 11 PRIOR ART
FIG. 11 is a vertical cross-sectional view of a conventional expander-compressor unit.
Figure 12A:
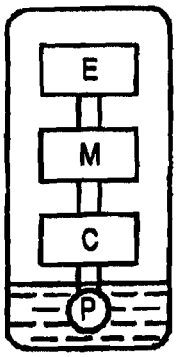
FIG. 12A PRIOR ART
FIG. 12A to FIG. 12D each is a layout of a conventional expander-compressor unit.
Figure 12B:
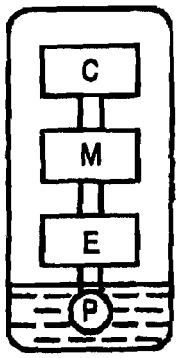
FIG. 12B PRIOR ART
Figure 12C:
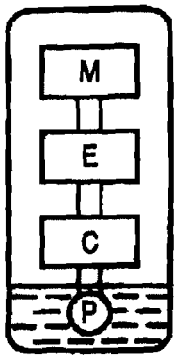
FIG. 12C PRIOR ART
Figure 12D:
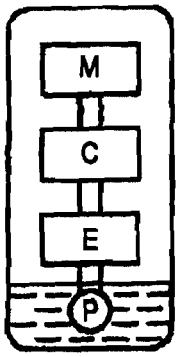
FIG. 12D PRIOR ART

In Embodiment 1 to 3, a configuration as shown in FIG. 5 may be employed. Contrary to Embodiment 1 to 3, the lower cylinder 41*a* has a height larger than that of the upper cylinder 41*b* in the configuration shown in FIG. 5. The first expansion chamber 47*a* is formed between the upper cylinder 41*b* and the piston 42*b*. The second expansion chamber 47*b* with a volumetric capacity larger than that of the first expansion chamber 47*a* is formed between the lower cylinder 41*a* and the piston 42*a*. That is, the second expansion chamber 47*b* is located under the first expansion chamber 47*a*. The discharge pipe 11 is connected to the lower bearing member 44, and the suction pipe 10 is connected to the bearing member 45. The suction passage 49 for guiding the refrigerant from the suction pipe 10 to the first expansion chamber 47*a* is formed in the bearing member 45.

Locating the second expansion chamber 47*b* under the first expansion chamber 47*a* like this makes it possible to have a relatively high temperature portion at an upper side while having a relatively low temperature portion at a lower side also in the expansion mechanism 4. Thereby, a more preferable temperature distribution can be obtained. The volumetric capacity of the second expansion chamber 47*b* may be set larger than that of the first expansion chamber 47*a* also in Modified Example by, for example, making the height of the upper cylinder 41*b* equal to the height of the lower cylinder 41*a*, and furthermore, making the inner diameter of the lower cylinder 41*a* larger than the inner diameter of the upper cylinder 41*b*, as described above.

<<Definition of Term in the Specification>>

In the present invention, "bottom portion" in the phrase "a closed casing having, in a bottom portion thereof, an oil reservoir for holding an oil" means a lower side with respect to an arbitrary predetermined position, and does not necessarily mean an absolute position. Accordingly, when the predetermined position is assumed to be higher than a mid-position of the closed casing in a vertical direction, a position higher than the mid-position also is included in the "bottom portion".

INDUSTRIAL APPLICABILITY

As having been described, the present invention is useful for expander-compressor units and refrigeration cycle apparatuses having the expander-compressor unit (such as a refrigerator, an air conditioner, and a water heater).

The invention claimed is:

1. An expander-compressor unit comprising:

a closed casing having, in a bottom portion thereof, an oil reservoir for holding an oil;

a motor provided in the closed casing;

a compression mechanism for compressing a working fluid drawn from outside of the closed casing and discharging it into the closed casing, the compression mechanism being disposed below the motor in the closed casing;

an expansion mechanism for allowing the working fluid drawn from outside of the closed casing to expand and discharging it out of the closed casing, the expansion mechanism being disposed below the compression mechanism in the oil reservoir in the closed casing;

a shaft extending vertically and being coupled to the motor, the compression mechanism, and the expansion mechanism;

a first oil supply passage for supplying the oil held in the oil reservoir to the compression mechanism; and a second oil supply passage for supplying the oil held in the oil reservoir to the expansion mechanism, wherein the compression mechanism and the expansion mechanism are separated from each other so that a buffer space extending around the shaft is formed between the compression mechanism and the expansion mechanism in the oil reservoir, a first oil suction portion for drawing the oil in the oil reservoir toward the first oil supply passage is located above the expansion mechanism and faces the buffer space, a second oil suction portion for drawing the oil in the reservoir toward the second oil supply passage is located below the first oil suction portion the shaft has a compression mechanism side shaft coupling the motor to the compression mechanism, and an expansion mechanism side shaft connected to the expansion mechanism, the expander-compressor unit further comprises a coupling mechanism for coupling the compression mechanism side shaft to the expansion mechanism side shaft at a position between the compression mechanism and the expansion mechanism a vertical flow passage extending in an axial direction of the compression mechanism side shaft and opening at least downward is formed in the compression mechanism side shaft;

a stopper member for closing a lower side of the vertical flow passage is inserted into a lower end portion of the compression mechanism side shaft;

a suction port opening laterally in the compression mechanism side shaft and leading to the vertical flow passage is formed in a portion of the compression mechanism side shaft, the portion being above the stopper member; and the vertical flow passage constitutes the first oil supply passage, and the suction port constitutes the first oil suction portion.

2. The expander-compressor unit according to claim 1, wherein the coupling mechanism is disposed in the buffer space.

3. The expander-compressor unit according to claim 1, further comprising a flow suppressing plate for suppressing flow of the oil, the flow suppressing plate being provided at a position below the first oil suction portion in the buffer space.

4. The expander-compressor unit according to claim 3, wherein:

the flow suppressing plate is an approximately annular plate that has, at a center side thereof, a hole into which the shaft is inserted, and that is fixed to the compression mechanism or the expansion mechanism; and a clearance is formed between an outer peripheral surface of the approximately annular plate and an inner peripheral surface of the closed casing.

5. The expander-compressor unit according to claim 3, wherein:

the flow suppressing plate is an approximately annular plate that has, at a center side thereof, a hole into which the shaft is inserted, and that has, at an outer periphery side thereof, a recessed portion recessed inward in a radial direction; and the approximately annular plate is fixed to an inner peripheral surface of the closed casing.

6. The expander-compressor unit according to claim 1, further comprising a bearing for supporting rotatably the compression mechanism side shaft, the bearing being disposed below the compression mechanism and having an inner peripheral surface facing an outer peripheral surface of the compression mechanism side shaft, wherein:

a groove extending vertically is formed in the outer peripheral surface of the compression mechanism side shaft, or the inner peripheral surface of the bearing;

a lower end portion of the groove faces the buffer space; and the groove constitutes the first oil supply passage, and the lower end portion of the groove constitutes the first oil suction portion.

7. The expander-compressor unit according to claim 1, further comprising a fixing member fixed to an inner peripheral surface of the closed casing, wherein the expansion mechanism is fixed to the fixing member.

8. The expander-compressor unit according to claim 1, wherein the expansion mechanism is a two-stage rotary expansion mechanism having a first expansion chamber, and a second expansion chamber that is located under the first expansion chamber, that is in communication with the first expansion chamber via a communication passage, and that has a volumetric capacity larger than that of the first expansion chamber.

9. A refrigeration cycle apparatus comprising:

the expander-compressor unit according to claim 1;

a first pipe for guiding from the closed casing the refrigerant compressed by the compression mechanism;

a radiator for allowing the refrigerant guided by the first pipe to radiate heat;

a second pipe for guiding to the expansion mechanism the refrigerant that has radiated heat in the radiator;

a third pipe for guiding the refrigerant that has expanded in the expansion mechanism;

an evaporator for allowing the refrigerant guided by the third pipe to evaporate; and a fourth pipe for guiding to the compression mechanism the refrigerant that has evaporated in the evaporator.

10. The expander-compressor unit according to claim 1, wherein the second oil suction portion is located below the expansion mechanism.

* * * * *